US010597184B2

(12) United States Patent
Yamazaki et al.

(10) Patent No.: US 10,597,184 B2
(45) Date of Patent: Mar. 24, 2020

(54) METHOD AND DEVICE FOR ASSEMBLING HEIGHT-ADJUSTABLE BOX

(71) Applicant: RENGO CO., LTD., Osaka (JP)

(72) Inventors: Naho Yamazaki, Tokyo (JP); Takafumi Makiuchi, Chiba (JP); Takahiro Yagoshi, Tokyo (JP); Masayuki Handa, Tokyo (JP)

(73) Assignee: RENGO CO., LTD., Osaka (JP)

( * ) Notice: Subject to any disclaimer, the term of this patent is extended or adjusted under 35 U.S.C. 154(b) by 396 days.

(21) Appl. No.: 15/429,790

(22) Filed: Feb. 10, 2017

(65) Prior Publication Data

US 2017/0190460 A1 Jul. 6, 2017

Related U.S. Application Data

(62) Division of application No. 14/371,478, filed as application No. PCT/JP2013/050779 on Jan. 17, 2013, now Pat. No. 9,821,925.

(30) Foreign Application Priority Data

Jan. 18, 2012 (JP) ..... 2012-007876

(51) Int. Cl.
*B65D 5/32* (2006.01)
*B65B 5/02* (2006.01)
(Continued)

(52) U.S. Cl.
CPC ..... *B65B 59/02* (2013.01); *B65B 5/02* (2013.01); *B65B 5/028* (2013.01); *B65B 11/50* (2013.01);
(Continued)

(58) Field of Classification Search
CPC ..... B65D 5/324; B65D 5/208; B65D 5/68; B65D 5/0055; B65B 57/12; B65B 65/02; B65B 59/02
(Continued)

(56) References Cited

U.S. PATENT DOCUMENTS 2,885,842 A * 5/1959 Boitel ..... B65B 25/14 229/132
3,744,700 A * 7/1973 Stegnnann ..... B65D 5/324 220/DIG. 25
(Continued)

FOREIGN PATENT DOCUMENTS

FR 2 606 367 5/1988
JP 49-063589 6/1974
(Continued)

OTHER PUBLICATIONS

Extended European Search Report dated Jul. 22, 2015, in corresponding European Application No. 13738998.7.

*Primary Examiner* — Christopher R Demeree
(74) *Attorney, Agent, or Firm* — Wenderoth, Lind & Ponack, L.L.P.

(57) ABSTRACT

A base sheet and a cover sheet are supplied, the height of at least one product which is placed on the base sheet is measured, and second fold lines are formed on the base sheet and the cover sheet such that the second fold lines are spaced from respective first fold lines formed on the respective side portions of the base sheet and the cover sheet and such that the space between each of the first fold lines and the corresponding one of the second fold lines is adjusted based on the value of the measured height of the product. The base sheet is folded, the base sheet and the cover sheet are arranged so that the base sheet crosses the cover sheet, the
(Continued)

cover sheet is placed on the base sheet, and the cover sheet is folded to bond the cover sheet to the bottom sheet.

1 Claim, 10 Drawing Sheets

(51) Int. Cl.

| | |
|---|---|
| ***B65B 43/26*** | (2006.01) |
| ***B65B 57/12*** | (2006.01) |
| ***B65B 65/02*** | (2006.01) |
| ***B65D 5/50*** | (2006.01) |
| ***B65B 43/10*** | (2006.01) |
| ***B65B 59/02*** | (2006.01) |
| ***B65B 11/50*** | (2006.01) |
| ***B65B 57/00*** | (2006.01) |
| *B65B 49/00* | (2006.01) |

(52) U.S. Cl.
CPC ..... *B65B 43/10* (2013.01); *B65B 43/265* (2013.01); *B65B 57/00* (2013.01); *B65B 57/12* (2013.01); *B65B 65/02* (2013.01); *B65D 5/324* (2013.01); *B65D 5/5028* (2013.01); *B65B 49/00* (2013.01); *B65B 2210/04* (2013.01); *B65D 2571/00567* (2013.01)

(58) Field of Classification Search
USPC ..... 229/100, 114, 125.28, 901, 125, 125.19, 229/125.29, 143, 149, 178, 125.125, 229/125.27, 125.31, 125.32, 132, 147, 229/151
See application file for complete search history.

(56) References Cited

U.S. PATENT DOCUMENTS

| | | | | |
|---|---|---|---|---|
| 3,817,018 | A | 6/1974 | Vickers | |
| 5,188,284 | A * | 2/1993 | Eisman | B65D 5/64 229/110 |
| 6,510,670 | B1 * | 1/2003 | Janhonen | B65B 25/14 271/227 |
| 2009/0031676 | A1 | 2/2009 | Boigues et al. | |
| 2009/0149306 | A1 | 6/2009 | Durand et al. | |

FOREIGN PATENT DOCUMENTS

| | | |
|---|---|---|
| JP | 57-035215 | 2/1982 |
| JP | 58-028369 | 2/1983 |
| JP | 2005-280802 | 10/2005 |
| JP | 2009-007029 | 1/2009 |

* cited by examiner

Fold line applying station C

Fold line applying station C

METHOD AND DEVICE FOR ASSEMBLING HEIGHT-ADJUSTABLE BOX

TECHNICAL FIELD

The present invention relates to a method and a device for assembling a height-adjustable box in which products that are different in height from each other can be packed according to the height of each of the products.

BACKGROUND ART

In recent years, it is common to order and purchase various products through the Internet. After receiving such orders through the Internet, sellers pack products having various sizes in boxes to send the products to consumers. When such products are packed in boxes, if various kinds of boxes are used according to the size of each of the products in light of transportation efficiency, it requires large costs to manage such boxes and choose an appropriate box from such boxes for each packing.

In order to overcome this problem, Japanese Unexamined Patent Application Publication No. 2009-7029 discloses a box which has foldable side walls so that the size of the box can be changed to several kinds of sizes.

Problems to be Solved by the Invention

However, since the size of such a box as disclosed in Japanese Unexamined Patent Application Publication No. 2009-7029 cannot be freely (steplessly) adjusted, it is impossible to make the gap inside the box as small as possible and improve transportation efficiency.

SUMMARY OF THE INVENTION

It is an object of the present invention to provide a method and a device for assembling a box for sending products in which the height of the box is freely (steplessly) changed according to the size of each of the products.

Means for Solving the Problems

In order to achieve the above object, an assembling method is provided in the present invention, the method comprising supplying a base sheet on which at least one product is to be placed and a cover sheet which is to be placed on the base sheet, measuring the height of the product, forming second fold lines on at least one of the base sheet and the cover sheet such that the second fold lines are spaced from respective first fold lines formed on respective side portions of the one of the cover sheet and the base sheet, wherein the space between each of the first fold lines and the corresponding one of the second fold lines is adjusted based on the value of the measured height of the product, folding the one of the base sheet and the cover sheet along each of the first fold lines and the corresponding one of the second fold lines in the same direction, and bonding the side portions of the one of the base sheet and the cover sheet to the other of the base sheet and the cover sheet.

In this assembling method, if the first fold lines are formed on the base sheet and the cover sheet beforehand, and the second fold lines are formed on the base sheet and the cover sheet after forming the first fold lines, the cover sheet is placed on the base sheet with the base sheet and the cover sheet arranged so that the base sheet crosses the cover sheet.

Furthermore, in order to close the gaps between the base sheet and the cover sheet in the corners of the box, cuts are formed in folded pieces provided on the base sheet through respective fold lines and protruding from both sides of the base sheet such that the cuts are on the extended lines of the respective second fold lines, whereby when the cover sheet is folded along the first and second fold lines, the respective folded pieces are separated from each other by the cuts so as to be along the inner surfaces of protruding pieces which protrude from both sides of the cover sheet.

Furthermore, in the above assembling method, the product is placed on the base sheet, the product is fixed in position by means of a film which extends to the outer surface of the bottom of the base sheet, and both ends of the cover sheet are bonded onto the base sheet by means of an adhesive which penetrates the film.

An assembling device for implementing this assembling method includes fold line applying tools opposed to each other and configured to form the second fold lines on the base sheet and the cover sheet, wherein the space between each of the first fold lines and the corresponding one of the second fold lines is adjusted based on the value of the measured height of the product by moving the fold line applying tools toward and away from each other, and wherein the assembling device is further configured to fold each of the base sheet and the cover sheet along each of the first fold lines and the corresponding one of the second fold lines in the same direction.

Furthermore, in the assembling device, respective folded pieces which protrude from both sides of the base sheet are formed with cuts formed by cutting blades integrally provided on the respective fold line applying tools so as to be along the inner surfaces of protruding pieces which protrude from both sides of the cover sheet.

Effects of the Invention

In the assembling method and device according to the present invention, fold lines are formed on the base sheet and the cover sheet, respectively, at positions determined based on the measured value of the height of the product, and each of the base sheet and the cover sheet is, at either side edge portion thereof, folded twice in the same direction along the fold lines and the other fold lines, to seal the box. Therefore, it is possible to freely (steplessly) adjust the height of the box according to the height of each product packed in the box, while sealing the box. As a result thereof, it is possible to reduce packing costs, make the gap inside the box as small as possible, and improve transportation efficiency.

It is also possible to close the gaps between the base sheet and the cover sheet in the corners of the box by folding the respective folded pieces which protrude from both sides of the base sheet such that the folded pieces are along the inner surfaces of protruding pieces which protrude from both sides of the cover sheet, thereby preventing dust from entering the interior of the box

BRIEF DESCRIPTION OF THE DRAWINGS

FIG. 8 (*b*) is a perspective view illustrating how the product is being packed in the height-adjustable box.

FIG. 9 (*b*) is a perspective view illustrating how the product is being packed in the height-adjustable box, in which the corners of the box are closed.

FIG. 10 (*b*) is a side view of the fold line applying station, which includes cutting blades.

BEST MODE FOR CARRYING OUT THE INVENTION

Figure 8:
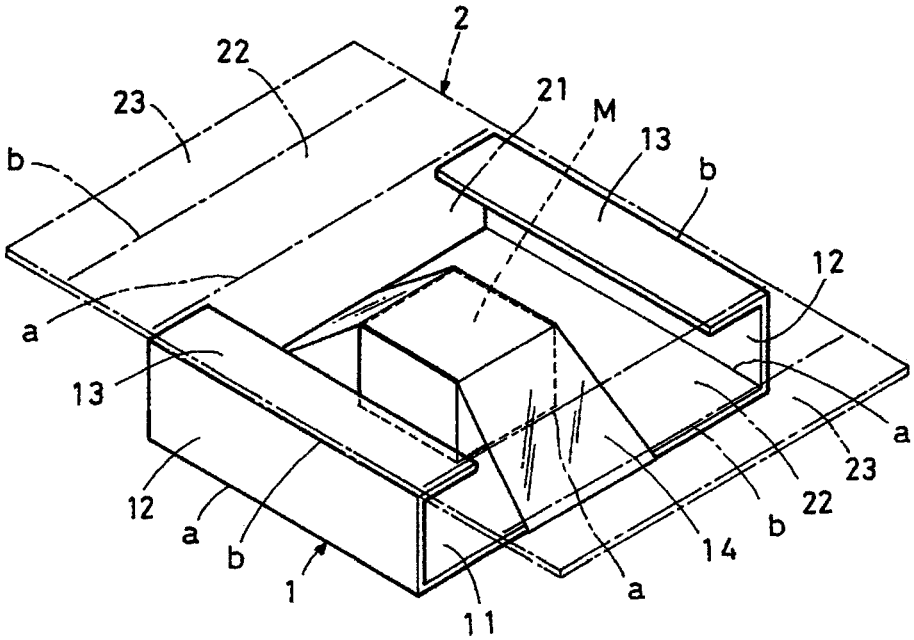
FIG. 8 (*a*) is a perspective view illustrating the step of packing a product in a height-adjustable box.
Figure 8:
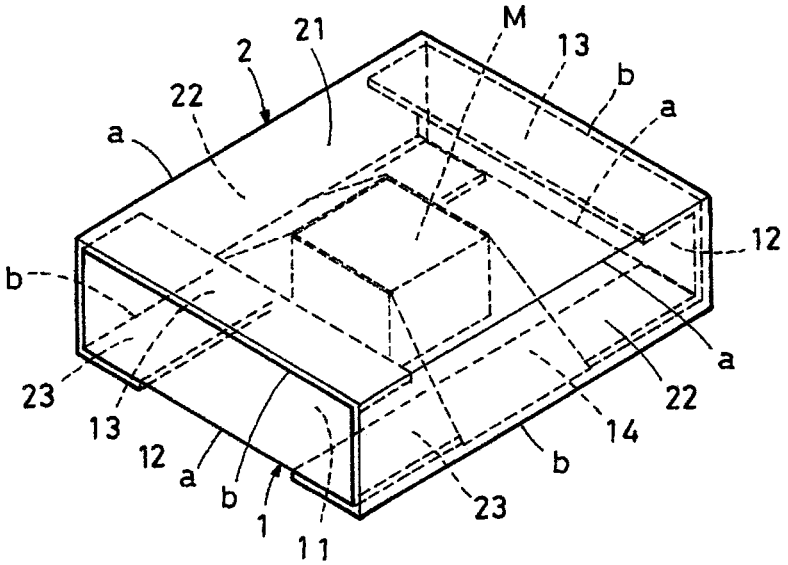

It is now described in the below-mentioned embodiment how a product M to be dispatched through mail order, etc. is packed in a height-adjustable box as illustrated in FIG. 8.

This height-adjustable box includes a base sheet 1 and a cover sheet 2 which are made of corrugated paperboard. The base sheet 1 includes a bottom sheet portion 11, side sheet portions 12, and folded sheet portions 13. The side sheet portions 12 are integrally connected to the bottom sheet portion 11 on both sides of the bottom sheet portion 11 through first fold lines "a" (first ruled lines "a"), while the side sheet portions 12 and the folded sheet portions 13 are integrally connected together through respective second fold lines "b" (second ruled lines "b"). The cover sheet 2 includes a top sheet portion 21, side sheet portions 22, and folded sheet portions 23. The side sheet portions 22 are integrally connected to the top sheet portion 21 on both sides of the top sheet portion 21 through first fold lines "a" (first ruled lines "a"), while the side sheet portions 22 and the folded sheet portions 23 are integrally connected together through respective second fold lines "b" (second ruled lines "b"). The product M is placed on the bottom sheet portion 11 and fixed in position by wrapping a film 14 over the product M.

The side sheet portions 12 of the base sheet 1 are bent upwardly along the first fold lines "a" of the base sheet 1, and the folded sheet portions 13 are each bent inwardly, i.e. in the same direction as the corresponding side sheet portion 12 is bent, along the corresponding second fold line "b" of the base sheet 1. In this state, the cover sheet 2 is placed on the base sheet 1 so as to cross the base sheet 1 to bond the top sheet portion 21 of the cover sheet 2 to the folded sheet portions 13 of the base sheet 1. The side sheet portions 22 of the cover sheet 2 are then bent downwardly along the first fold lines "a" of the cover sheet 2, and the folded sheet portions 23 of the cover sheet 2 are each bent inwardly, i.e. in the same direction as the corresponding side sheet portion 22 is bent, along the corresponding second fold line "b" of the cover sheet 2. The folded sheet portions 23 of the cover sheet 2 are then bonded to the bottom sheet portion 11.

It is now described with reference to FIGS. 1 to 7 as to the steps of assembling the base sheet 1 and the cover sheet 2 into the above height-adjustable box, and packing the product M in the height-adjustable box, in an assembling device according to the present invention.

Figure 1:
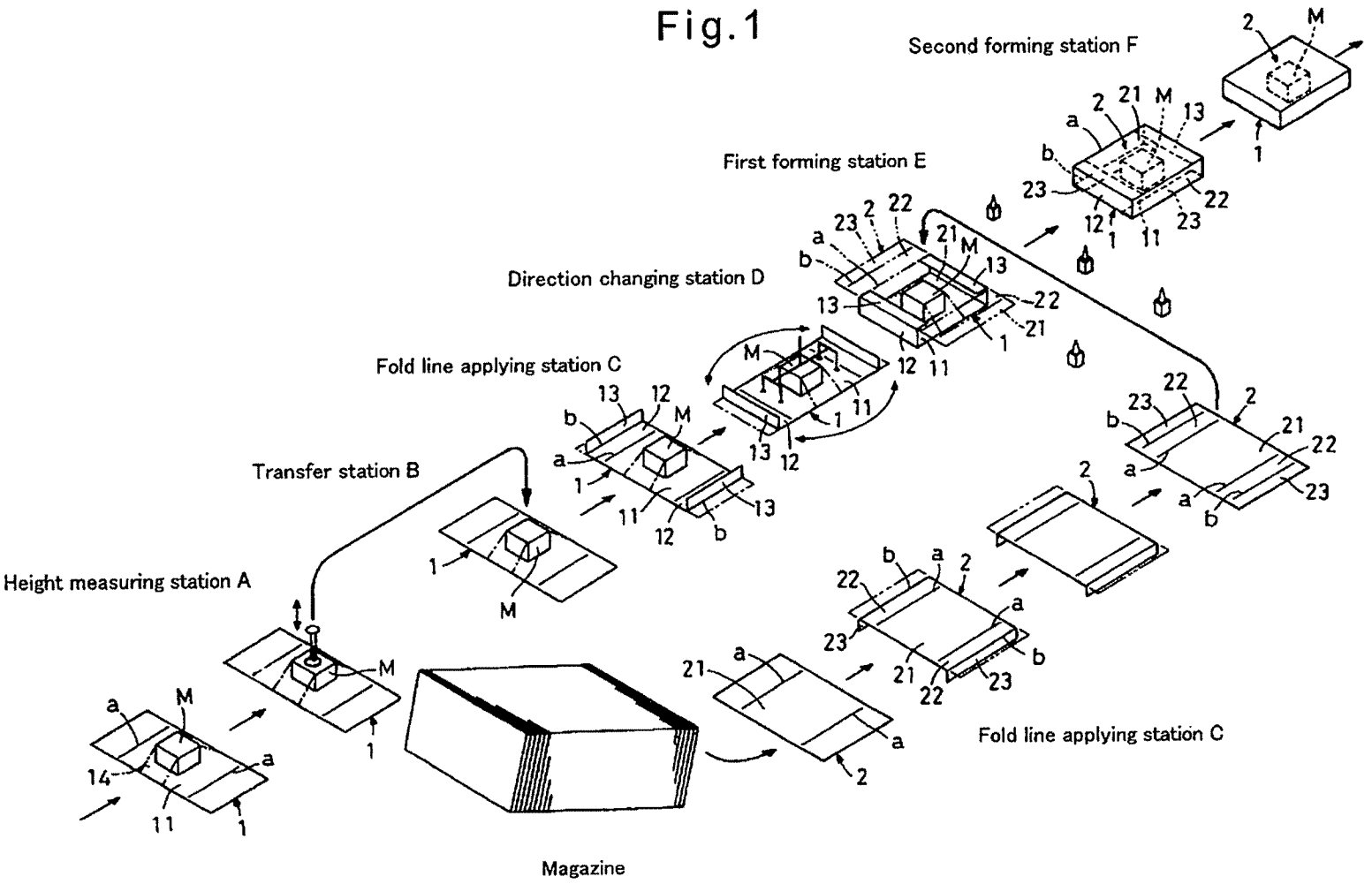
FIG. 1 is a perspective view schematically illustrating the whole of an assembling method and device according to the present invention.

As illustrated in FIG. 1, the assembling device includes, from upstream to downstream, a height measuring station A, a transfer station B, a fold line (ruled line) applying station C, a direction changing station D, a first forming station E, and a second forming station F.

In the upstream process (before the height measuring station A), the first fold lines "a" are applied (formed) on both sides of the bottom sheet portion 11 so as to be spaced from the respective edges of the base sheet 1, and the product M is placed on the bottom sheet portion 11 and fixed in position by wrapping the film 14 over the product M. After that, the base sheet 1 is sent by conveyor from the upstream process to the height measuring station A. The cover sheet 2 is taken out from a magazine, with the first fold lines "a" applied (formed) on both sides of the top sheet portion 21 so as to be spaced from the respective edges of the cover sheet 2.

Figure 2:
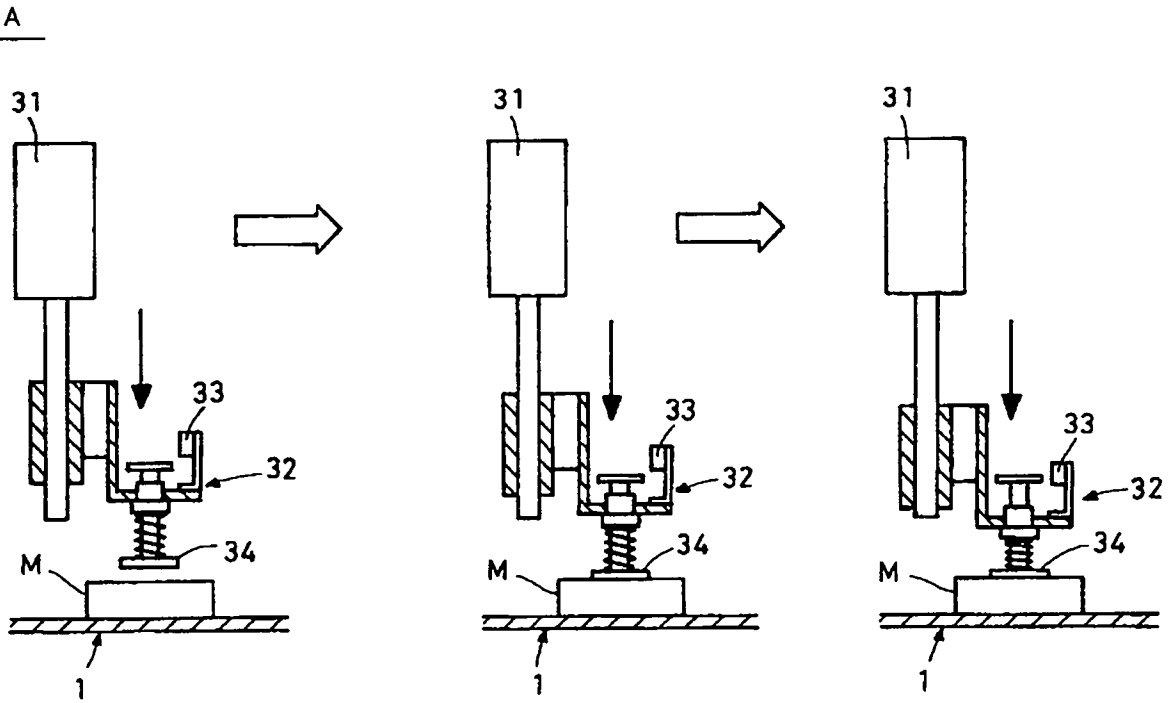
FIG. 2 is an explanatory view illustrating how a height measuring station of FIG. 1 operates.

As illustrated in FIG. 2, the height measuring station A is provided with a height detecting mechanism. The height detecting mechanism includes a servomotor 31, and a moving member 32 which moves up and down when the servomotor 31 rotates and which is provided with a sensor 33 and a contactor 34 biased downwardly by a spring. This height detecting mechanism is configured such that when the moving member 32 moves down and thereby the contactor 34 abuts the product M, the sensor 33 detects and measures the height of the product M. Alternatively, the height detecting mechanism may be of a non-contact type such as the type in which the height is judged based on a picture taken by camera, or the type in which a phototube is used.

Figure 3:
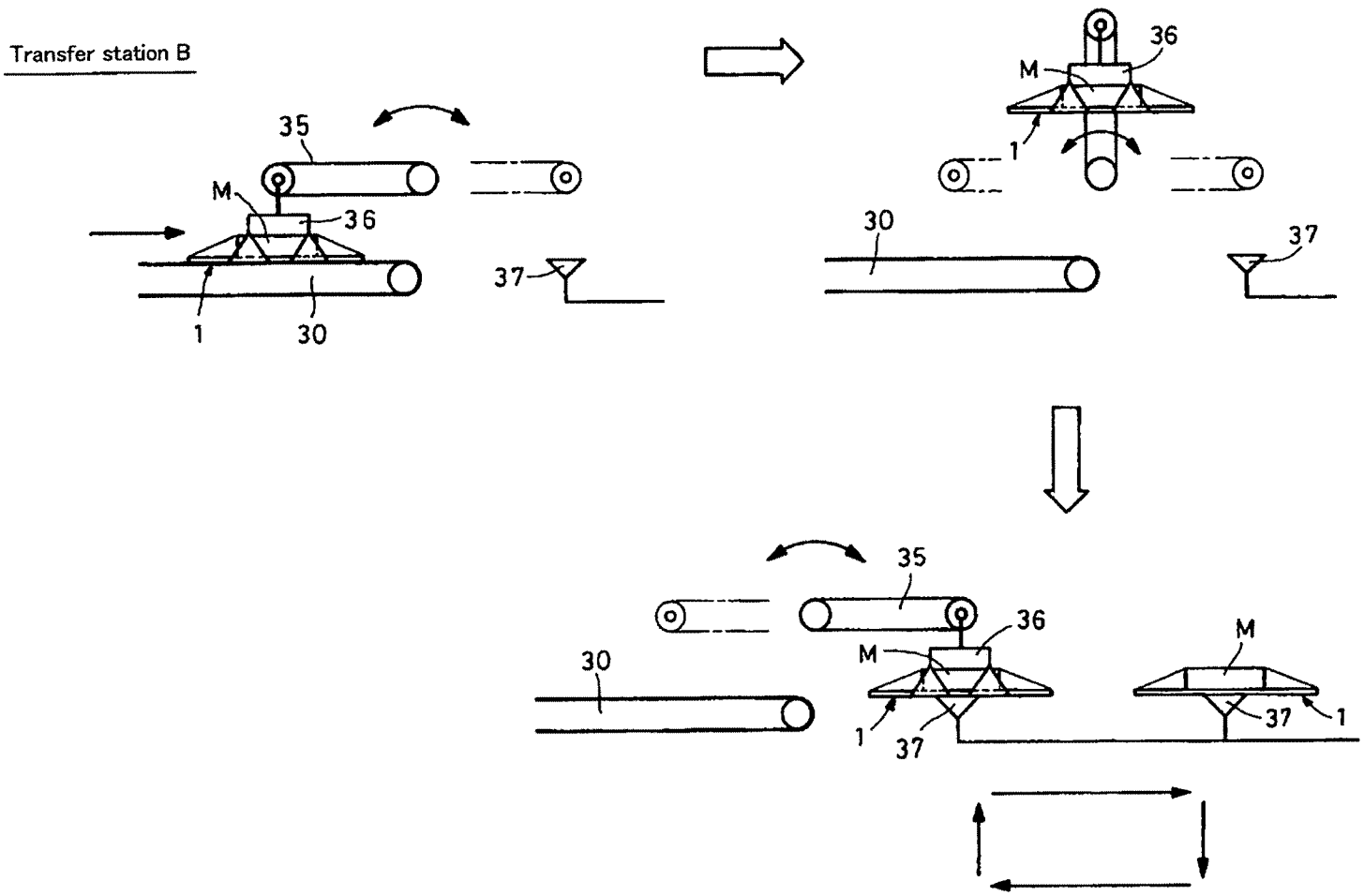
FIG. 3 is an explanatory view illustrating how a transfer station of FIG. 1 operates.

As illustrated in FIG. 3, the transfer station B is provided with a transfer mechanism. The transfer mechanism includes an arm 35 which is pivotable on a vertical plane, and a holding member 36 pivotally mounted to the distal end portion of the arm 35. With the base sheet 1, on which the product M is placed, grabbed by the holding member 36 of the transfer mechanism, the arm 35 is pivoted to lift the base sheet 1 off a conveyor 30 and transfer the base sheet 1 onto one of a plurality of buckets 37 circulating in the transfer station B.

Figure 4:
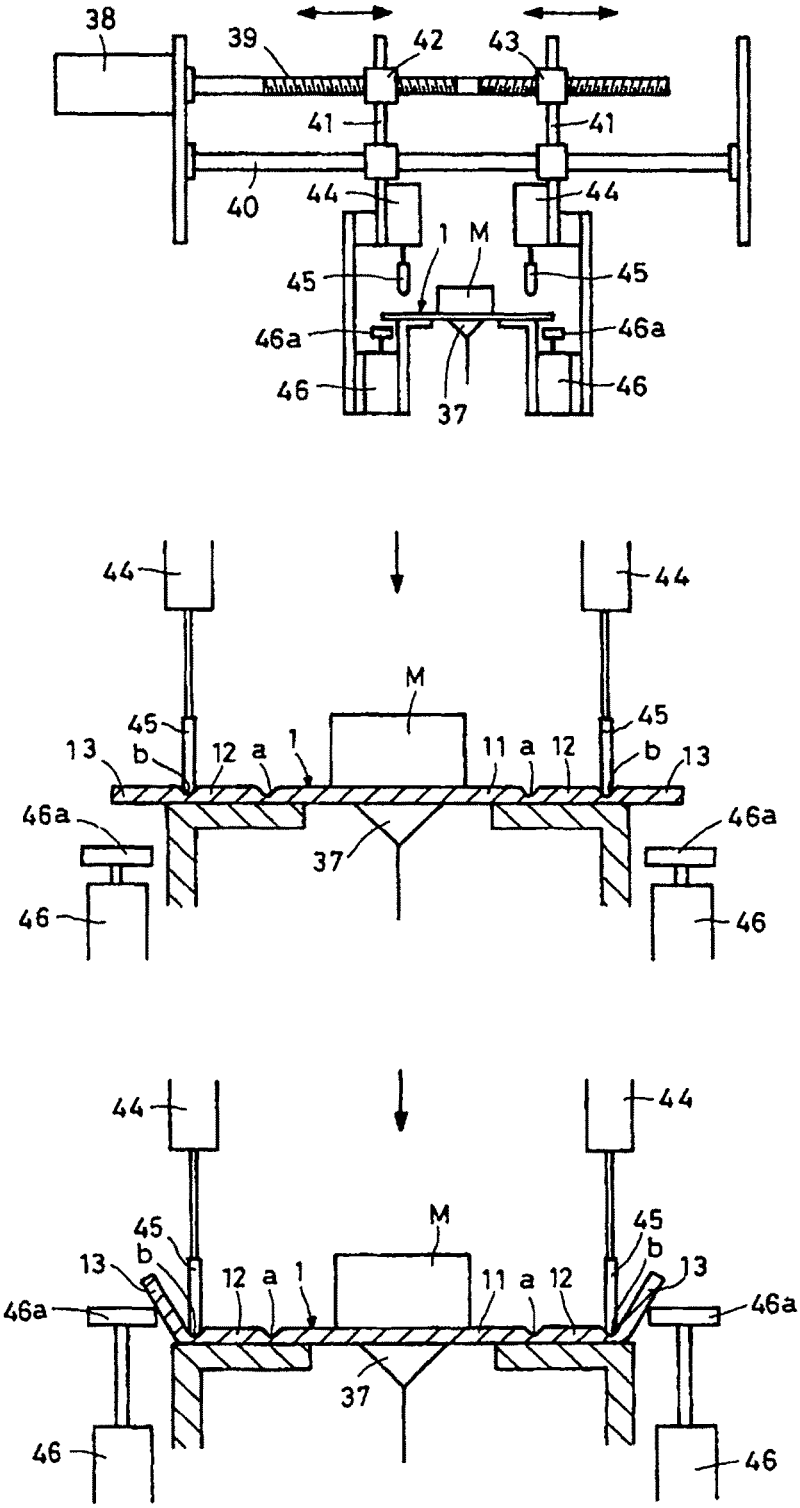
FIG. 4 is an explanatory view illustrating how a fold line applying station of FIG. 1 operates.

As illustrated in FIG. 4, the fold line applying station C is provided with a fold line (ruled line) applying mechanism. The fold line applying mechanism includes a servomotor 38, a screw shaft 39 which is rotated by the servomotor 38, a guide shaft 40, a pair of moving rods 41 supported by the guide shaft 40, and nuts 42 and 43 provided on the respective moving rods 41 and kept in threaded engagement with the screw shaft 39, the winding directions of the internal threads of the nuts 42 and 43 being different from each other. The fold line applying mechanism further includes cylinders 44 provided at the lower portions of the respective moving rods 41, and fold line (ruled line) applying tools 45 provided at the lower portions of the shafts of the respective cylinders 44. With this arrangement, when the screw shaft 39 is rotated, the fold line applying tools 45 are moved toward or away from each other. The cylinders 44 move the respective fold line applying tools 45 up and down. Also, the fold line applying station C is provided with a pre-folding mechanism. The pre-folding mechanism includes pressers 46*a* provided outwardly and downwardly of the respective fold line applying tools 45, and cylinders 46 which move the respective pressers 46*a* up and down.

As the fold line applying tools 45, instead of tools which move up and down as illustrated in FIG. 4, rotary type tools, i.e. disk-shaped rotating tools may be used.

In this fold line applying station C, the servomotor 38 is driven based on the value of the height of the product M measured in the height measuring station A, to move the fold line applying tools 45 toward or away from each other. The fold line applying tools 45 are then moved down by the respective cylinders 44. As a result thereof, the second fold lines "b" of the base sheet 1 are formed between the respective first fold lines "a" of the base sheet 1 and the edges of the base sheet 1 so as to be parallel to and spaced apart a predetermined distance from the first fold lines "a" of the base sheet 1, thereby defining the side sheet portions 12 between the respective first fold lines "a" and the second fold lines "b" of the base sheet 1, and the folded sheet portions 13 between the respective second fold lines "b" of the base sheet 1 and the edges of the base sheet 1.

With the positions of the respective second fold lines "b" of the base sheet 1 pressed by the fold line applying tools 45, the pressers 46*a* are moved up by the respective cylinders 46 to pre-fold the folded sheet portions 13.

Though not illustrated in the drawings, as in the base sheet 1, the second fold lines "b" of the cover sheet 2 are formed between the respective first fold lines "a" of the cover sheet 2 and the edges of the cover sheet 2 so as to be parallel to and spaced apart a predetermined distance from the first fold lines "a" of the cover sheet 2, thereby defining the side sheet portions 22 between the respective first fold lines "a" and the second fold lines "b" of the cover sheet 2, and the folded sheet portions 23 between the respective second fold lines "b" of the cover sheet 2 and the edges of the cover sheet 2. The folded sheet portions 23 are then pre-folded.

Figure 5:
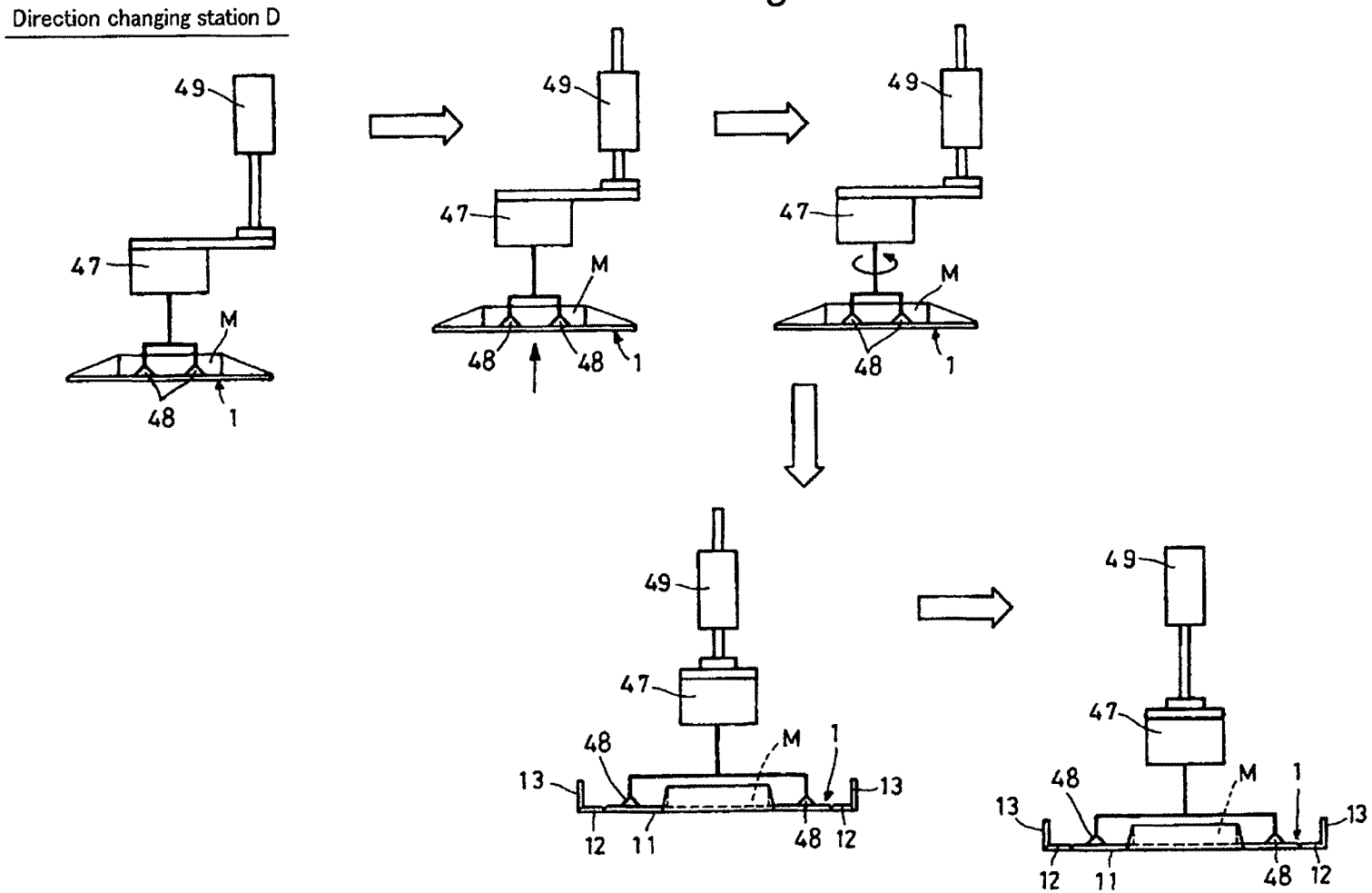
FIG. 5 is an explanatory view illustrating how a direction changing station of FIG. 1 operates.

As illustrated in FIG. 5, the direction changing station D is provided with a lift-and-pivot mechanism. The lift-and-pivot mechanism includes a rotary actuator 47, a sucker 48 provided at the lower portion of a shaft of the rotary actuator 47, and a cylinder 49 which moves the sucker 48 up and down. The lift-and-pivot mechanism is configured such that the sucker 48 sucks the base sheet 1 onto the sucker 48, the cylinder 49 lifts up the base sheet 1, the rotary actuator 47 turns the base sheet 1 so as to change the direction of the base sheet 1 by 90 degrees, and the cylinder 49 lifts down the base sheet 1.

Figure 6:
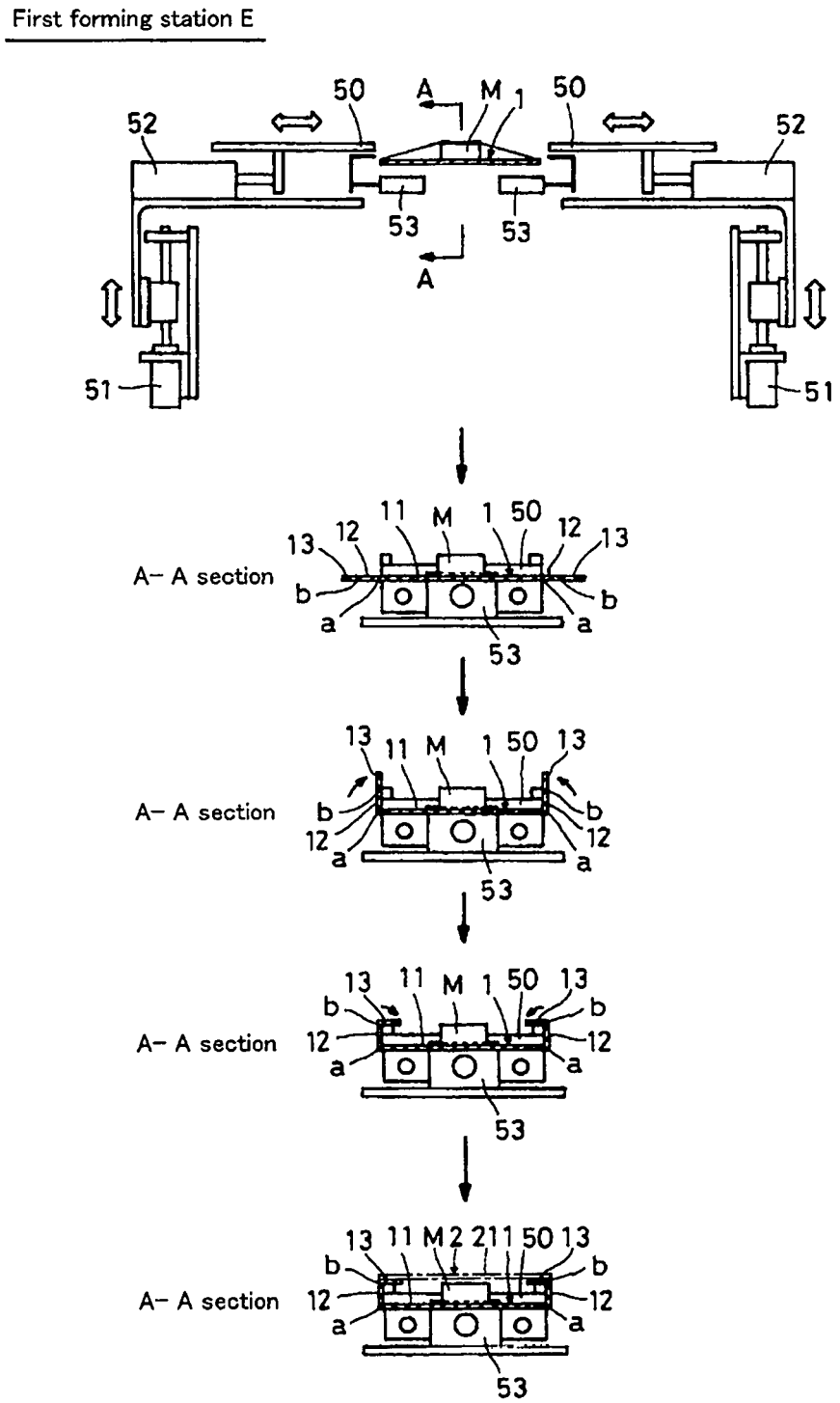
FIG. 6 is an explanatory view illustrating how a first forming station of FIG. 1 operates.

As illustrated in FIG. 6, the first forming station E is provided with a mandrel moving mechanism. The mandrel moving mechanism includes servomotors 51 which move respective mandrels 50 up and down, and cylinders 52 which move the respective mandrels 50 back and forth. The mandrel moving mechanism moves the mandrels 50 toward the base sheet 1 while keeping the mandrels 50 at a height determined based on the value of the height of the product M measured in the height measuring station A, with the bottom sheet portion 11 of the base sheet 1 upwardly pressed by sheet pressers 53. As a result, each of the side sheet portions 12 and the corresponding folded sheet portion 13 are folded in the same direction along the first fold line "a" and the second fold line "b", respectively.

In this state, after applying hot-melt adhesive to the folded sheet portions 13, the cover sheet 2 is placed on the base sheet 1, and the top sheet portion 21 of the cover sheet 2 is pressed against the folded sheet portions 13 of the base sheet 1 to bond them together. Hot-melt adhesive is applied to the folded sheet portions 23 of the cover sheet 2 too, after folding the pre-folded folded sheet portions 23 in the opposite direction along the respective second fold lines "b" of the cover sheet 2.

Figure 7:
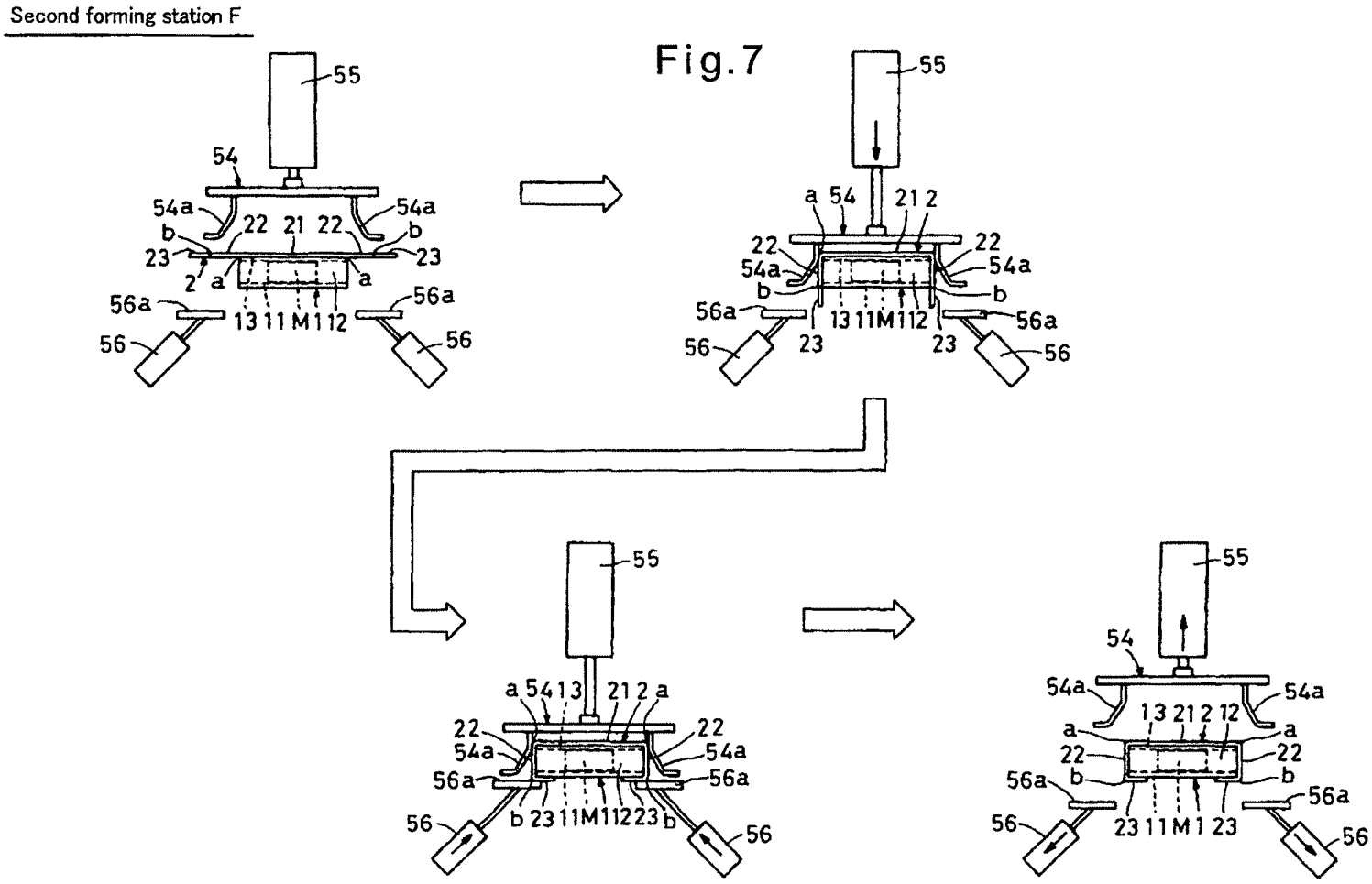
FIG. 7 is an explanatory view illustrating how a second forming station of FIG. 1 operates.

As illustrated in FIG. 7, the second forming station F is provided with a fold guiding mechanism. The fold guiding mechanism includes a fold guide 54, a pair of guide plates 54*a* mounted to the fold guide 54 such that the distance therebetween gradually decreases toward the fold guide 54, and a servomotor 55 which moves the fold guide 54 up and down. The second forming station F is further provided with a folding and press-bonding mechanism arranged downwardly of the fold guiding mechanism. The folding-and-press-bonding mechanism includes a pair of pressers 56*a*, and cylinders 56 which move the respective pressers 56*a* obliquely upward and downward such that the pressers 56*a* are moved toward each other when the pressers 56*a* are moved upward.

In this second forming station F, the servomotor 55 moves down the fold guide 54 to a position corresponding to the height of the side sheet portions 12 based on the value of the height of the product M measured in the height measuring station A, thereby downwardly bending the side sheet portions 22 along the respective first fold lines "a" of the cover sheet 2. In this state, the cylinders 56 obliquely move up the respective pressers 56*a*, thereby bending the folded sheet portions 23 inwardly along the respective second fold lines "b" of the cover sheet 2 until the folded sheet portions 23 are pressed against and bonded to the outer surface of the bottom sheet portion 11.

By using this assembling method and device, the second fold lines "b" are formed on the base sheet 1 and the cover sheet 2, respectively, at positions determined based on the measured value of the height of the product M, and each of the base sheet 1 and the cover sheet 2 is, at either side edge portion thereof, folded twice in the same direction along the first and second fold lines, to seal the box. Therefore, it is possible to freely (steplessly) adjust the height of the box according to the height of the product M packed in the box, while sealing the box. As a result thereof, it is possible to reduce packing costs, make the gap inside the box as small as possible, and improve transportation efficiency.

Figure 9:
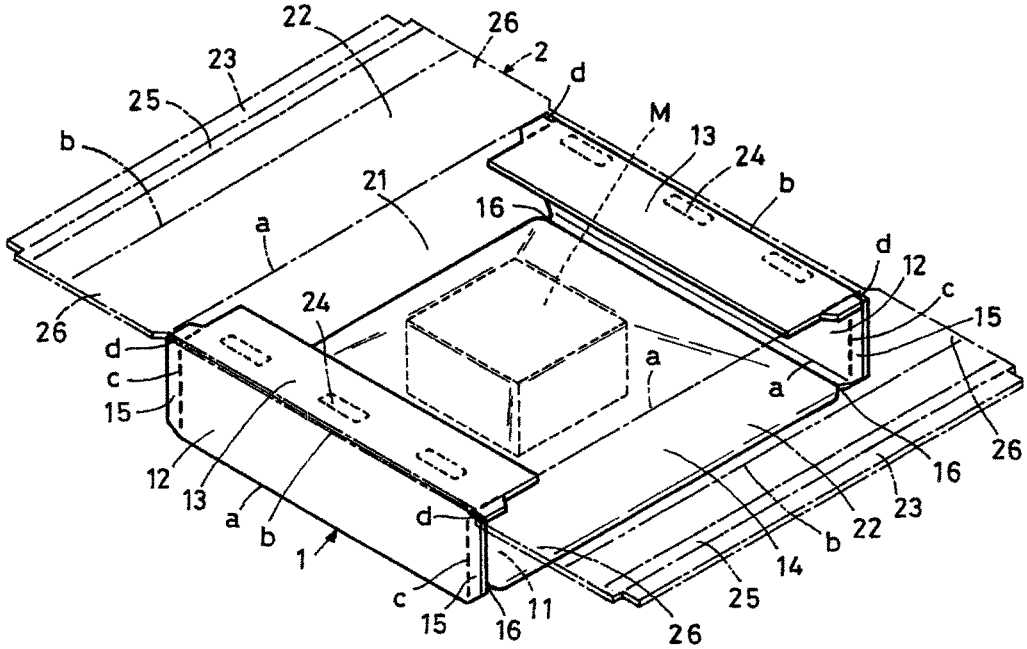
FIG. 9 (*a*) is a perspective view illustrating the step of packing the product in the height-adjustable box such that the corners of the box are closed.
Figure 9:
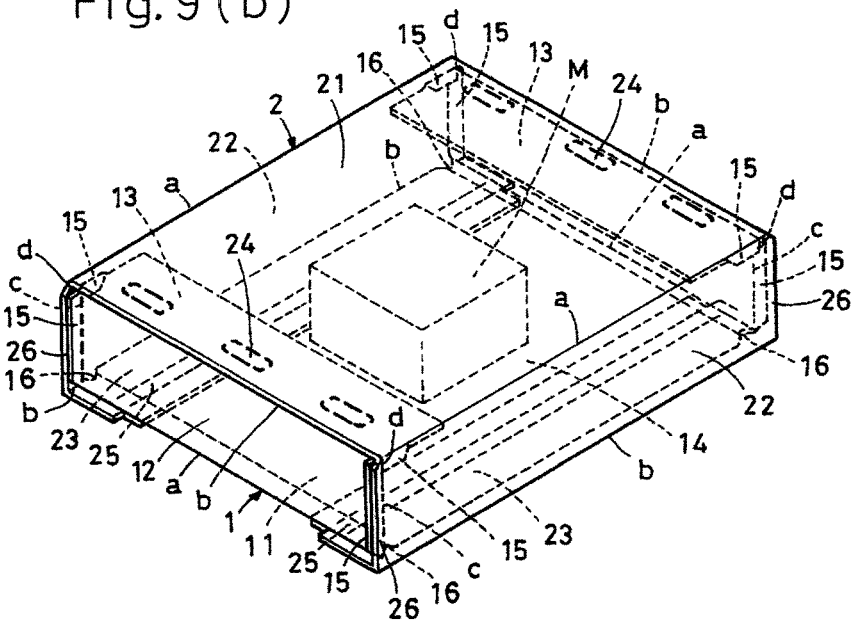

As illustrated in FIG. 9, this assembling method and device may include an additional step and tool so as to assemble a height-adjustable box of which the base sheet 1 has folded pieces 15 provided continuously on both sides of the respective side plates 12 and both sides of the respective folded sheet portions 13 so as to protrude through perforated fold lines "c" from both sides of the side plates 12 and the folded sheet portions 13, and of which the cover sheet 2 has protruding pieces 26 provided continuously on both sides of the respective side plates 22 and both sides of the respective folded sheet portions 23 so as to protrude from both sides of the side plates 22 and the folded sheet portions 23.

In such a height-adjustable box, the folded pieces 15 of the base sheet 1 may be formed with cuts "d" in the portions of the folded pieces 15 which are on the extended lines of the respective second fold lines "b" of the base sheet 1. With this arrangement, when the cover sheet 2 is, at either side edge portion thereof, folded twice in the same direction along the first and second fold lines "a" and "b", the respective folded pieces 15 are separated from each other by the cuts "d", the portions of the folded pieces 15 extending from both sides of the respective side plates 12 are outwardly bent naturally so as to be along the inner surfaces of the protruding pieces 26, and the portions of the folded pieces 15 extending from both sides of the respective folded sheet portions 13 are downwardly bent so as to be along the inner surfaces of the side sheet portions 22. As a result thereof, the gaps between the base sheet 1 and the cover sheet 2 in the corners of the box are closed.

Figure 10:
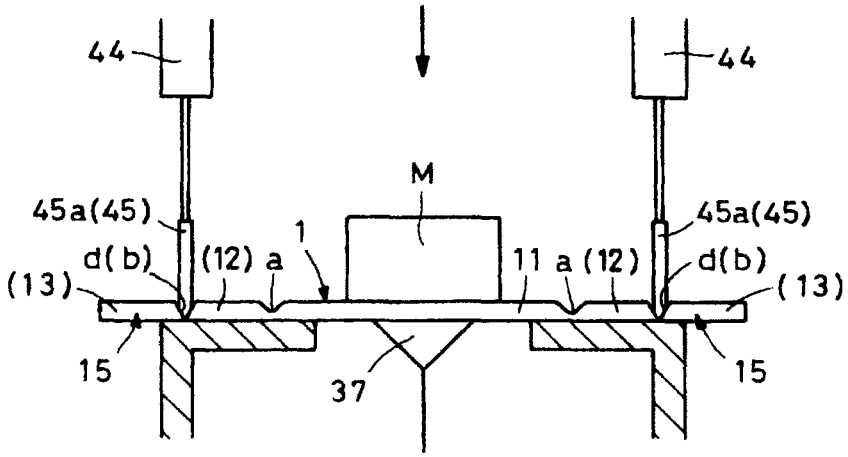
FIG. 10 (*a*) is an explanatory view illustrating how the fold line applying station of the assembling device in FIG. 1 operates.
Figure 10:
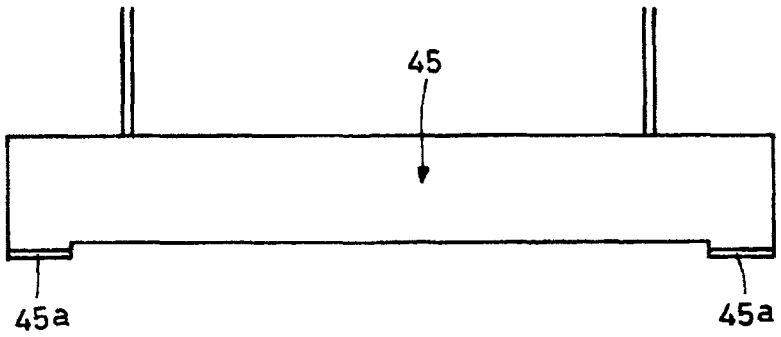

It is now described as to how the cuts "d" are formed by the assembling device. As illustrated in FIG. 10, in the fold line applying station C, the cylinders 44 move the respective fold line applying tools 45 up and down, which are at both ends of the tools 45 integrally provided with cutting blades 45*a*, so that the cuts "d" are formed at the same time when the second fold lines "b" of the base sheet 1 are formed.

In the height-adjustable box illustrated in FIG. 9, the film 14, by which the product M is fixed in position on the base sheet 1, is wide enough to reach the positions of the bottom sheet portion 11 which are close to boundaries between the bottom sheet portion 11 and the respective side sheet portions 12. The film 14 is attached to positioning recesses 16 formed at both ends of both sides of the bottom sheet portion 11, respectively so as to be positioned relative to the bottom sheet portion 11.

The cover sheet 2 has adhesive portions 24 provided at both ends of the top sheet portion 21, which are to be placed on the folded sheet portions 13, and surrounded by respective cut lines, the adhesive portions 24 being cut when the box is opened. The cover sheet 2 also has tear strips 25 made of, for example, cut tapes or cut lines for opening the box and provided at the portions close to both ends of the cover sheet 2, which are to be attached onto the bottom sheet portion 11. The base sheet 1 and the cover sheet 2 are bonded together at the adhesive portions 24 and at portions between the tear strips 25 and the end edges of the folded sheet portions 23.

At this time, the folded sheet portions 23 of the cover sheet 2 are bonded to the outer surface of the bottom sheet portion 11 by means of hot-melt adhesive which penetrates through the film 14 by melting the film 14. However, the film 14 may have holes formed therein beforehand by means of hot air or a punch so that the respective folded sheet portions 23 and the bottom sheet portion 11 are bonded together by means of hot-melt adhesive filling the holes in the film 14.

In the above embodiment, as one example, hot-melt adhesive is applied onto the folded sheet portions 13 so that the top sheet portion 21 are pressed against and bonded to the folded sheet portions 13. However, if the folded sheet portions 13 have a sufficient length, no hot-melt adhesive may be applied onto the folded sheet portions 13, since such folded sheet portions 13 do not move outwardly through the top sheet portion 21 so that the folded sheet portions 13 and the top sheet portion 21 are kept attached onto each other.

In the above embodiment, the base sheet 1 and the cover sheet 2 are fed into the fold line applying station C of the assembling device, with the first fold lines "a" formed on the base sheet 1 and the cover sheet 2 beforehand, and only the second fold lines "b" are formed on the base sheet and the cover sheet in the fold line applying station. But instead, both the first and second fold lines "a" and "b" may be formed in the fold line applying station C.

Also, in the above embodiment, the first and second fold lines "a" and "b" are formed both on the base sheet 1 and the cover sheet 2. But the first and second fold lines "a" and "b" may be formed only on one of the base sheet 1 and the cover sheet 2. In the latter case, the above one of the base sheet 1 and the cover sheet 2 is bent along the first and second fold lines in the above-described manner, and bonded at both end portions thereof to the other of the base sheet and the cover sheet.

DESCRIPTION OF REFERENCE NUMERALS

1: base sheet
2: cover sheet
11: bottom sheet portion
12: side sheet portion
13: folded sheet portion
14: film
15: folded piece
16: positioning recess
21: top sheet portion
22: side sheet portion
23: folded sheet portion
24: adhesive portion
25: tear strip
26: protruding piece
a: first fold line
b: second fold line
d: cut
A: height measuring station
B: transfer station
C: fold line applying station
D: direction changing station
E: first forming station
F: second forming station
30: conveyor
31: servomotor
32: moving member
33: sensor
34: contactor
35: arm
36: holding member
37: bucket
38: servomotor
39: screw shaft
40: guide shaft
41: moving rod
42, 43: nut
44: cylinder
45: fold line applying tool
45*a*: cutting blade
46: cylinder
46*a*: presser
47: rotary actuator
48: sucker
49: cylinder
50: mandrel
51: servomotor
52: cylinder
53: sheet presser
54: fold guide
54*a*: guide plate
55: servomotor
56: cylinder
56*a*: presser
M: product

The invention claimed is:

1. A height-adjustable box comprising:

a base sheet and a cover sheet which are made of corrugated paperboard, wherein the base sheet comprises side sheet portions and folded sheet portions on both sides of a bottom sheet portion through first fold lines and second fold lines, and the cover sheet comprises side sheet portions and folded sheet portions on both sides of a top sheet portion through first fold lines and second fold lines, wherein the side sheet portions and the folded sheet portions of the base sheet are bent upwardly along the first fold lines and the second lines, the cover sheet is positioned on the base sheet with the base sheet and the cover sheet arranged so that the base sheet crosses the cover sheet, the top sheet portion is bonded to the folded sheet portions of the base sheet, the side sheet portions and the folded sheet portions of the cover sheet are bent downwardly along the first fold lines and the second fold lines, and the folded sheet portions of the cover sheet are bonded to the bottom sheet portion, wherein the cover sheet comprises protruding pieces which protrude from both sides of the cover sheet and are continuous from the first fold lines of the cover sheet to the folded sheet portions of the cover sheet; and the base sheet comprises folded pieces, each of the folded pieces being separated into a first folded piece portion which protrudes from a corresponding one of the side sheet portions of the base sheet through a corresponding fold line of the base sheet and a second folded piece portion which protrudes from a corresponding one of the folded sheet portions of the base sheet through a respective fold line, by a cut disposed on an extension of a corresponding one of the second fold lines of the base sheet such that the first folded piece portion is bent outwardly so as to be disposed along an inner surface of a corresponding one of the protruding pieces of the cover sheet and the second folded piece portion is bent downwardly so as to be disposed along an inner surface of a corresponding one of the side sheet portions of the cover sheet so as to close a gap between the base sheet and the cover sheet at a corresponding corner of the height-adjustable box.

* * * * *